US005469588A

United States Patent [19]

DiMatteo et al.

[11] Patent Number: 5,469,588

[45] Date of Patent: Nov. 28, 1995

[54] PATIENT TRANSFER ARRANGEMENT

[75] Inventors: Paul DiMatteo; Paul C. DiMatteo, both of Dix Hills, N.Y.

[73] Assignee: Nova Technologies, Inc., Hauppauge, N.Y.

[21] Appl. No.: 182,953

[22] Filed: Jan. 18, 1994

Related U.S. Application Data

[63] Continuation-in-part of Ser. No. 908,988, Jul. 6, 1992, Pat. No. 5,319,813.

[51] Int. Cl.[6] ..... A61G 7/10

[52] U.S. Cl. ..... 5/81.1; 5/626; 5/612; 5/184

[58] Field of Search ..... 5/81.1, 600, 613, 5/602, 612, 624, 181, 184

[56] References Cited

U.S. PATENT DOCUMENTS

| | | | |
|---|---|---|---|
| 3,886,610 | 6/1975 | Shelden | 5/81.1 |
| 4,682,376 | 7/1987 | Feldt | 5/181 |
| 4,819,283 | 4/1989 | DiMatteo et al. | 5/81 R |
| 4,968,013 | 11/1990 | Kuck | 5/624 X |
| 5,020,171 | 6/1991 | DiMatteo et al. | 5/81.1 |
| 5,103,512 | 4/1992 | DiMatteo et al. | 5/610 |
| 5,390,379 | 2/1995 | Palmer, Jr. et al. | 5/81.1 |

FOREIGN PATENT DOCUMENTS

| | | | |
|---|---|---|---|
| 742870 | 12/1943 | Germany | 5/81.1 |

*Primary Examiner*—Michael F. Trettel
*Attorney, Agent, or Firm*—Belknap, Webb & Tyler Patterson

[57] ABSTRACT

A hospital bed is disclosed which includes a frame, a mattress positioned on the frame, a transport sheet extending across the mattress to define a patient supporting area, rollers for moving the transport sheet relative to the mattress, and structure for progressively increasing the patient supporting area defined by the transport sheet. The bed also includes a system for elevating a portion of the mattress to progressively raise the patient from a reclining position to a standing position.

33 Claims, 9 Drawing Sheets

PATIENT TRANSFER ARRANGEMENT

BACKGROUND OF THE INVENTION

This is a continuation-in-part of pending application U.S. Ser. No. 07/908,988 filed on Jul. 6, 1992, now U.S. Pat. No. 5,319,813, which is hereby incorporated by reference.

1. Field of the Invention

This invention relates to a patient transfer system, and more particularly, to a hospital bed for transferring a patient from a reclining position on the bed to a standing position at the foot of the bed.

2. Description of Related Art

The process of transferring a patient from a reclined position on a hospital bed to a standing position, or to a wheelchair, commode, or toilet, or assisting such a person in such a transfer, often involves the aide of more than one person, is labor-intensive and can be extremely costly. The task frequently requires considerable strength and is occasionally a source of injury to the patient, nurse, or attendant. These problems can be factors that cause a person to remain hospitalized or moved to a nursing home, rather than being cared for at home.

It is a well-established fact that prolonged bed rest is harmful to a person's health and can cause deterioration of many physical functions. Hospitals and rehabilitation facilities commonly use tilt tables to elevate patients appropriately as part of their treatment. It is an object of the subject invention to provide a tilt table function as part of a bed which is also equipped to transfer a person to a wheelchair, using a moving transfer seat.

A particular problem associated with patient care in hospitals involves patient rehabilitation following spinal surgery. It has been found, however, to be advantageous to the healing process to gradually change the angular orientation of the patient so as to incrementally increase the force of gravity on the spinal column.

Accordingly, it is an object of the subject invention to provide a hospital bed configured to transfer a patient from a reclined position upon the bed to a standing position at the foot of the bed with minimal effort on the part of an attendant.

It is another object of the subject invention to provide a tilt table function as part of a bed which is also equipped to transfer a person to a wheel chair, using a moving transfer sheet.

It is another object of the subject invention to provide a hospital bed which is configured to incrementally increase the angle of inclination of a patient lying on the bed to aide in rehabilitation following spinal surgery.

SUMMARY OF THE INVENTION

A hospital bed is provided which includes a frame, a mattress positioned upon the frame, and a transport sheet extending across the mattress to define a patient supporting area. Roller means are provided for moving the transport sheet relative to the mattress and means are provided for progressively increasing the patient supporting area of the transport sheet.

Preferably, the means for increasing the patient supporting area is defined by a linearly extendable platform which includes guide means for accommodating movement of the transport sheet with respect thereto and a frame having telescoping frame members. Actuation means are also provided for moving the platform from a retracted position to an extended position. The actuation means may comprise a rack and pinion assembly which is driven by an electrical drive system, or, in the alternative, the actuation means may be a pneumatic actuation assembly which includes a plurality of pneumatic actuators arranged in series within the telescoping frame members of the platform.

In a preferred embodiment of the subject invention, the bed is configured to facilitate movement of a patient from a reclining position on the bed to a standing position at the foot of the bed. Accordingly, the bed includes lift means for elevating a portion of the mattress to progressively raise the patient from a reclining position to a standing position.

In use, when a patient is to be translated from a reclining position to a standing position, the operator extends the platform to increase the patient supporting area of the transport sheet. Subsequently, the roller means are actuated to move the legs of the patient onto the platform. Then, the lift means is actuated to progressively elevate the patient to a standing position. In certain instances, such as, for example, following spinal surgery, it may be desirable to temporarily position a patient in an inclined position so as to gradually increase the force of gravity on the spinal column. Accordingly, the lift means may be actuated to incrementally increase the angle of inclination over a period of time until the patient has recovered from the surgery.

These and other features of the subject invention will become more readily apparent to those having ordinary skill in the art from the following detailed description of the invention taken in conjunction with the drawings.

BRIEF DESCRIPTION OF THE DRAWINGS

So that one skilled in the art to which the subject invention appertains will better understand how to make and use the invention, preferred embodiments of the method and apparatus will be described hereinbelow with reference to the drawings wherein.

DETAILED DESCRIPTION OF THE PREFERRED EMBODIMENTS

Figure 1:
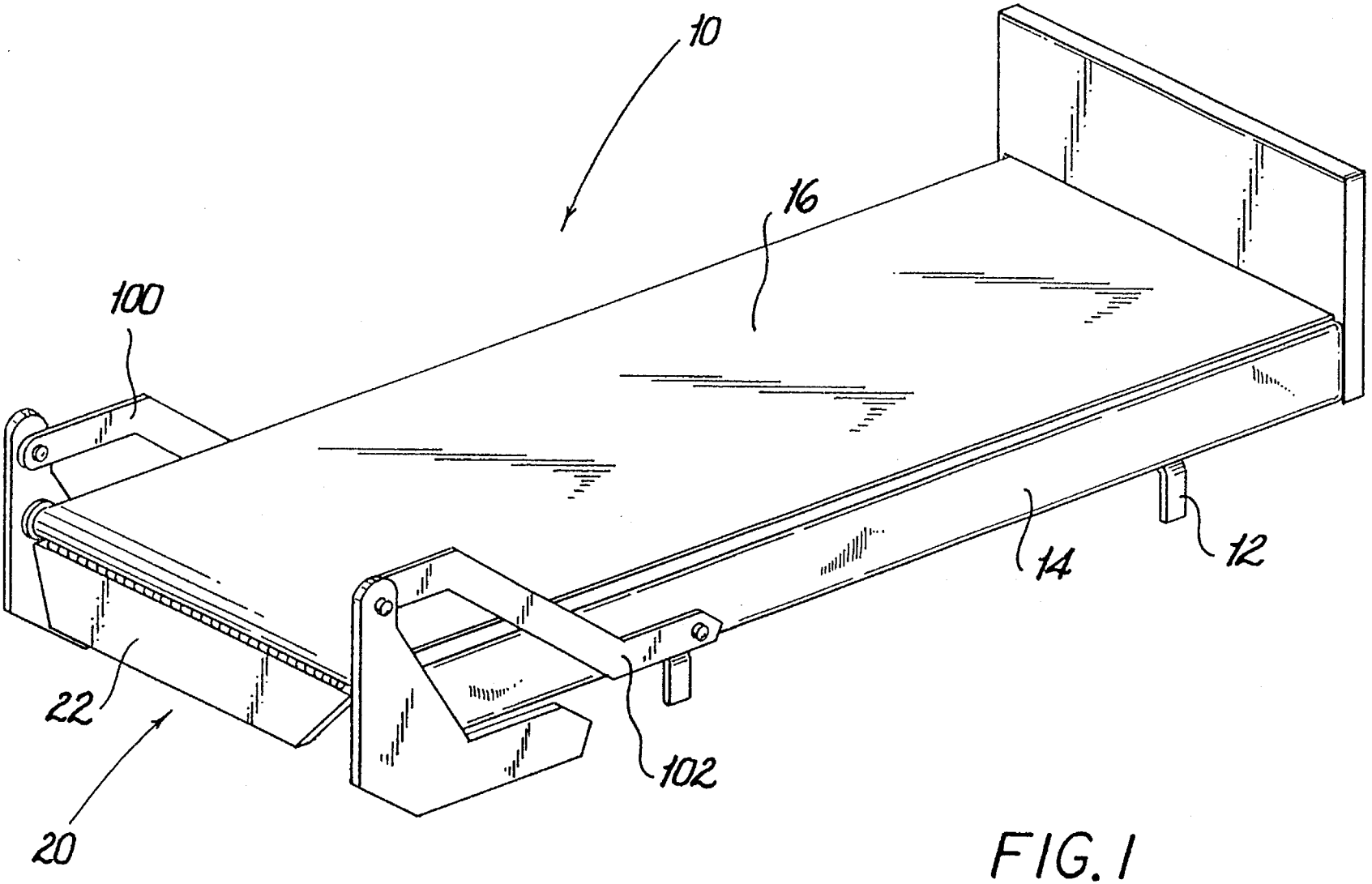
FIG. 1 is a perspective view of a hospital bed constructed in accordance with a preferred embodiment of the subject invention with the extendable platform disposed in a retracted position.
Figure 2:
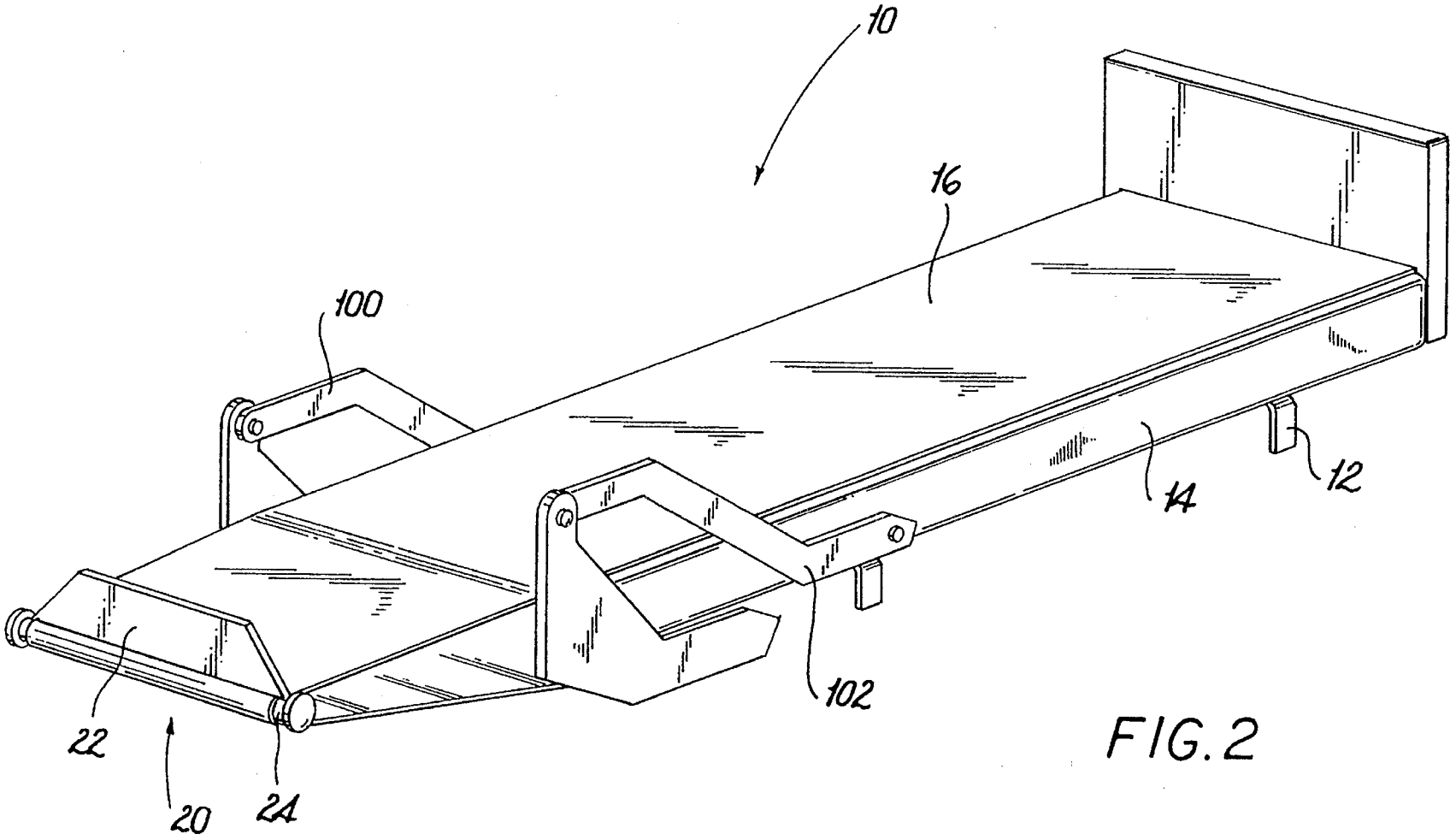
FIG. 2 is a perspective view of the hospital bed of FIG. 1 with the platform disposed in a fully extended position to increase the patient supporting area of the transfer sheet.

Referring now to the drawings wherein like reference numerals indicate similar structural elements, there is illustrated in FIGS. 1 and 2 a hospital bed constructed in accordance with a preferred embodiment of the subject invention and designated generally by reference numeral 10. In brief, hospital bed 10 comprises a bed frame 12, a mattress 14 positioned upon the bed frame 12, and a conveyor sheet 16 which extends across mattress 14 and moves relative thereto to translate a patient across the bed. A hospital bed employing a conveyor sheet arrangement such as that which is utilized in the subject invention, is described, for example, in commonly assigned U.S. Pat. No. 4,819,283, the disclosures of which are herein incorporated by reference. In general, as illustrated in FIGS. 8–11, conveyor sheet 16 is operatively associated with a pair of transport rollers 18*a* and 18*b* which are mounted to the bed frame 12 beneath the mattress 14 and an idler roller 18*c*. Transport rollers 18*a* and 18*b* may be driven by an electric motor or a hand crank to wind conveyor sheet 16 about one roller while unwinding conveyor sheet 16 from the other roller. Other arrangements for moving conveyor sheet 16 relative to mattress 14 to transport a patient across the bed are also envisioned, and are within the scope of the subject invention.

As best seen in FIG. 2, hospital bed 10 includes a linearly extendable platform 20 which is configured to increase the linear dimension of the patient supporting area defined by the conveyor sheet 16. Platform 20 includes a footrest 22 which is adapted to pivot between a downturned position shown in FIG. 1, and an upturned position shown in FIG. 2. Platform 20 also includes a transverse guide roller 24 which is configured to accommodate the guided translation of conveyor sheet 16 with respect to platform 20.

Figure 3:
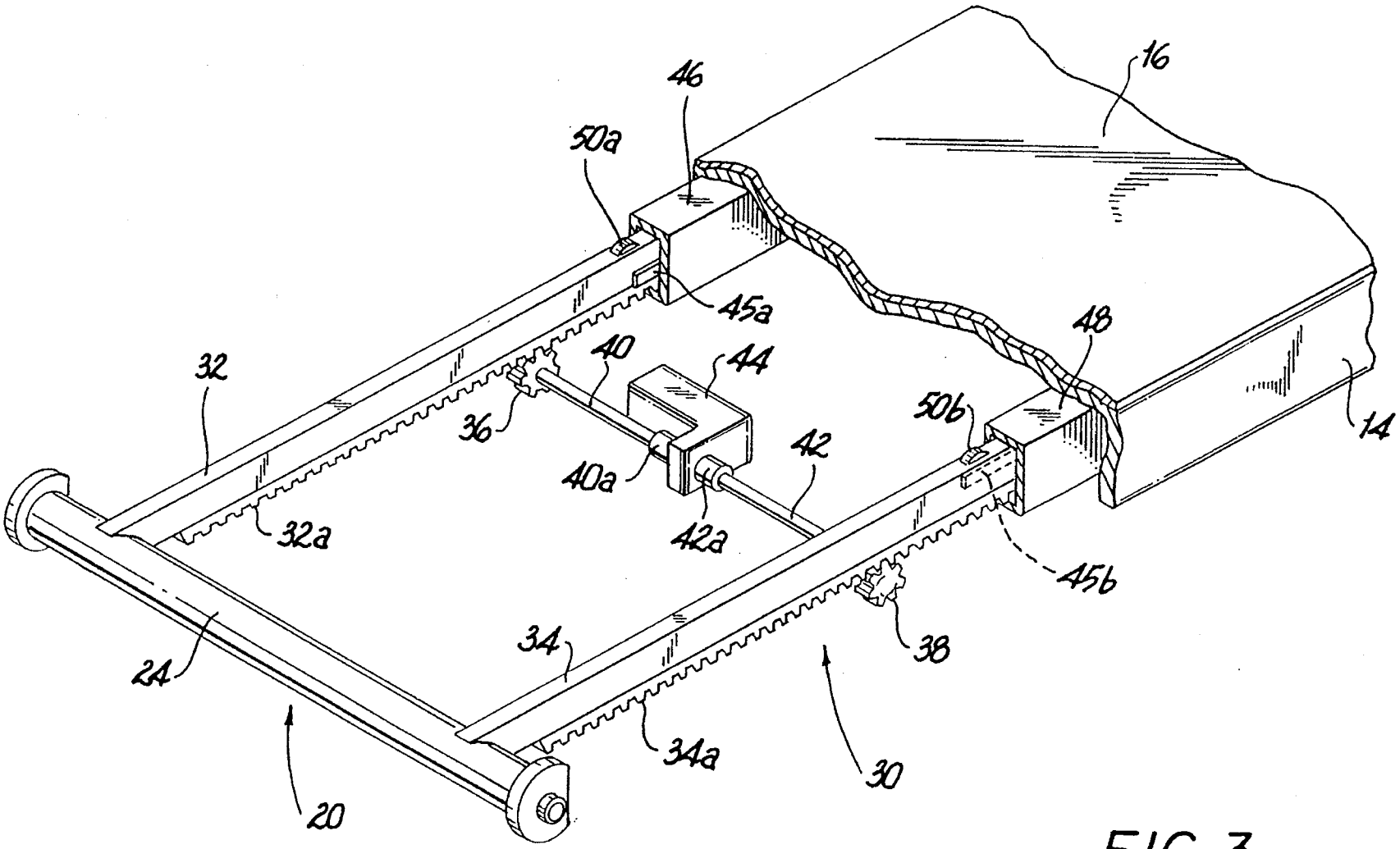
FIG. 3 is a perspective view of the platform frame with the rack and pinion actuation assembly illustrated.

Referring to FIG. 3, there is illustrated a mechanical actuation assembly generally designated by reference numeral 30 which is configured to progressively extend and retract platform 20 to adjust the patient supporting area defined by conveyor sheet 16. Mechanical actuation assembly 30 includes parallel gear racks 32*a* and 34*a* which are provided on the undersurface of platform frame extensions 32 and 34 respectively, and spaced apart pinion gears 36 and 38 which interact with gear racks 32*a* and 34*a*. Pinion gears 36 and 38 are mounted on respective drive shafts 40 and 42 which extend to corresponding universal joints 40*a* and 42*a*. Universal joints 40*a* and 42*a* interconnect drive shafts 40 and 42 to an electrical drive motor 44.

The platform frame extensions 32 and 34 respectively interact with tubular frame members 46 and 48 and are dimensioned to extend telescopically therefrom. Radial roller bearings 50*a* and 50*b* are mounted to the platform frame extensions 32 and 34 respectively, for bearing the cantilevered load imparted by the patient's legs when platform 20 is disposed in an extended position. Also provided are acetal or nylon blocks 45*a* and 45*b* which are mounted to the ends of tubular frame members 46 and 48 for preventing unwanted contact between the telescoping frame components of platform 20 and minimizing lateral movement therebetween.

Figure 4:
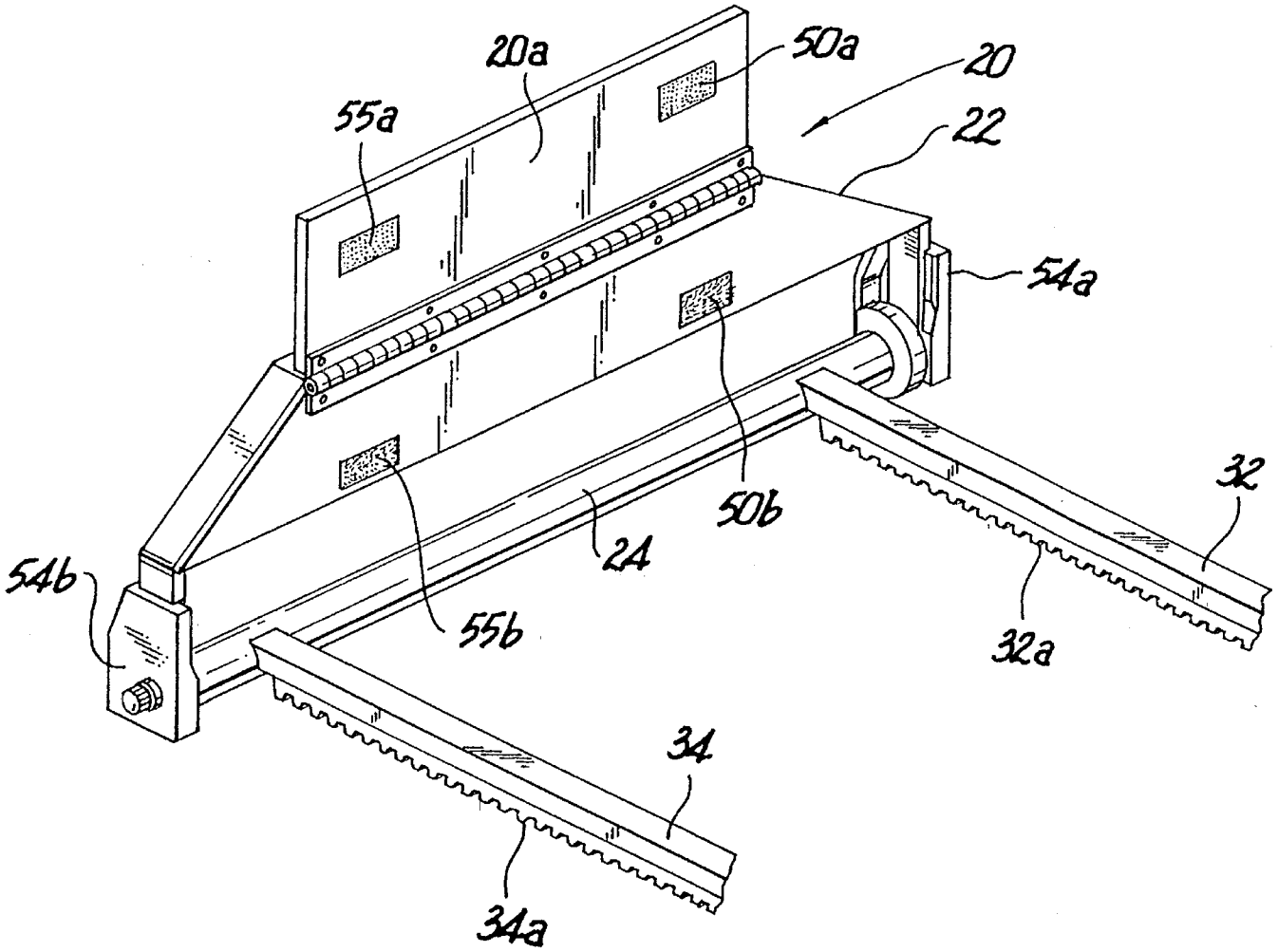
FIG. 4 is a perspective view of a portion of the platform frame which includes a folding platform section.

As shown in FIG. 4, platform 20 may include a hinged extension panel 20*a*. In this instance, cooperative hook and loop type fasteners such as 55*a* and 55*b* may be provided to maintain the extension panel 20*a* in a closed position during storage. Also shown in FIG. 4, are latches 54*a* and 54*b* which are provided for holding platform 20 in an upright position during utilization.

Figure 5:
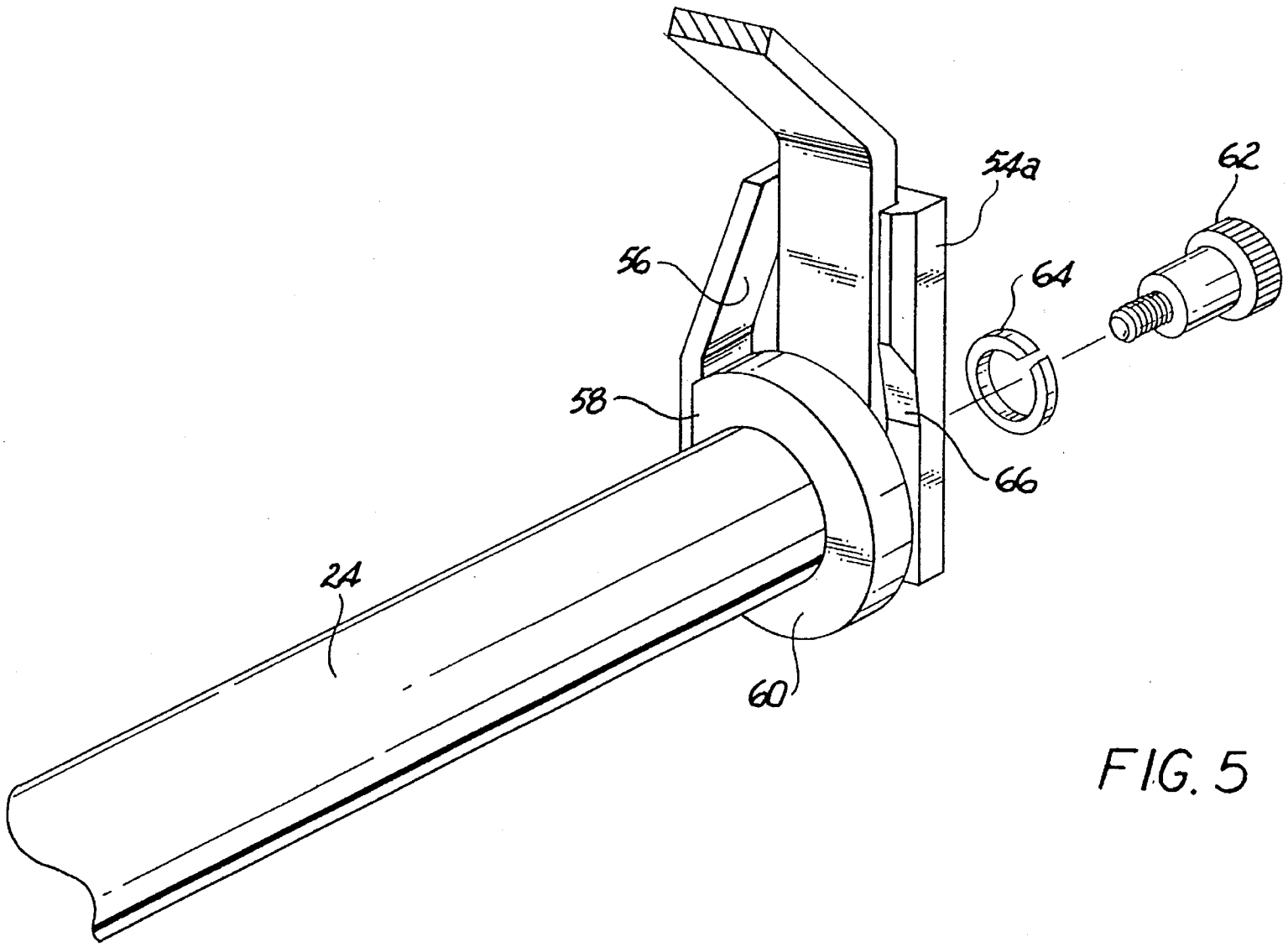
FIG. 5 is an enlarged exploded perspective view of a latch assembly associated with the extendable platform.

FIG. 5 illustrates platform latch 54*a* more clearly. In particular, the latch includes a blocking surface 56 for abutting a flattened surface 58 formed on the shoulder 60 of guide roller 24. A threaded fastener 62 is provided for preventing rotation of shoulder 60 relative to the guide roller 24. A curved spring washer 64 is also provided for exerting a biasing force upon the latch to hold it in place during utilization. Bevels 66 are formed on the latch such that the platform locks in an upright position when it is lifted. When pressure is exerted upon blocking surface 56, the platform is released so that it may be lowered.

Figure 6:
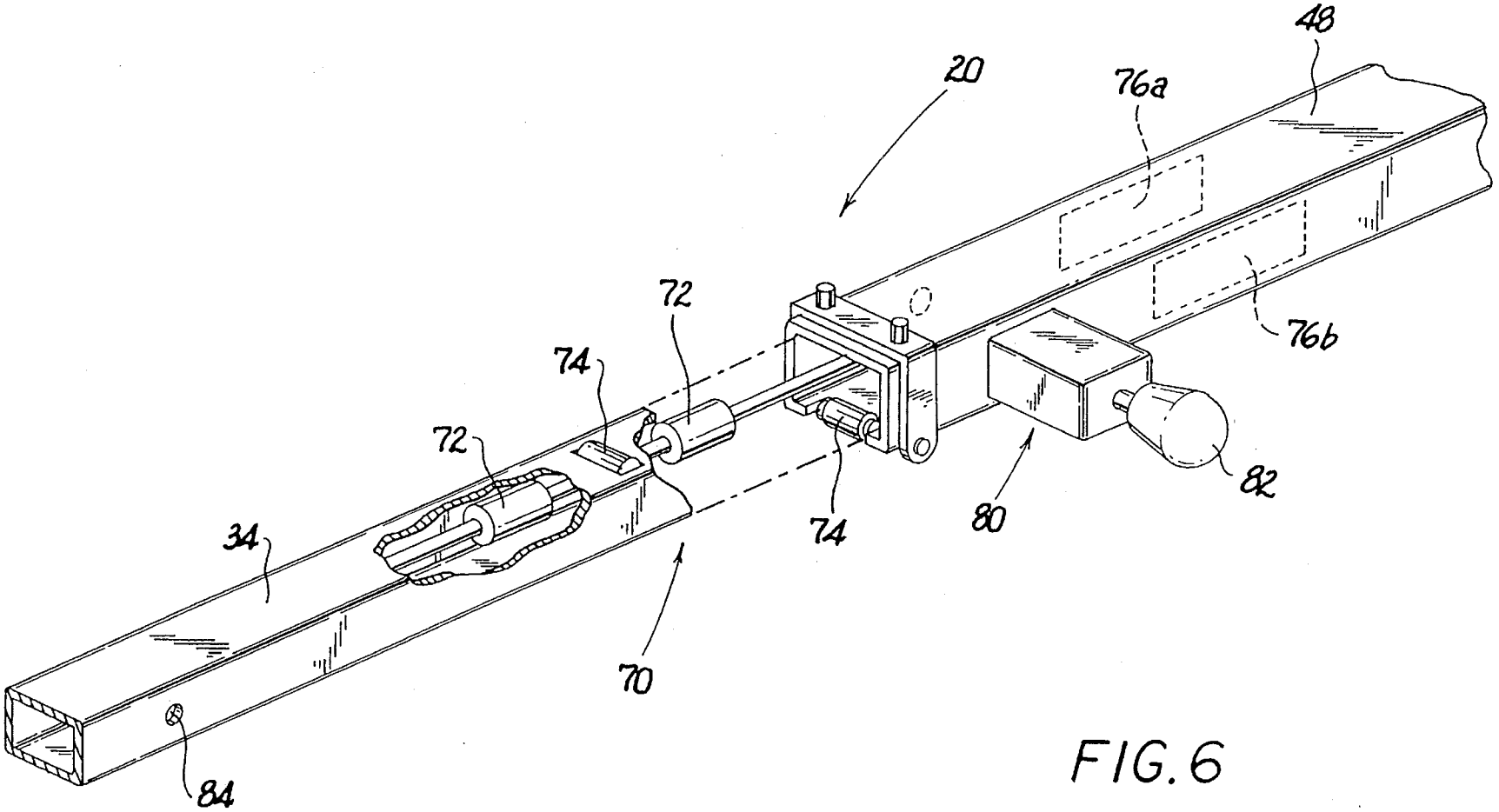
FIG. 6 is an exploded perspective view of the telescoping frame members of the platform illustrating the pneumatic actuation system disposed therein.

Turning now to FIG. 6, there is illustrated a gas spring assembly designated generally by reference numeral 70 for effectuating the linear extension and retraction of platform 20 to increase the patient supporting area defined by the transport sheet 16. The gas spring actuation assembly 70 includes a plurality of gas springs 72 connected in series within the telescoping frame extensions 32 and 34 of platform 20. Actuators 72 provide the necessary force to extend platform 20 while the conveyor sheet 16 provides the necessary force to counteract the force of the actuators to retract platform 20.

Radial roller bearings 74 are also mounted within frame extensions 32 and 34 for bearing the weight of the frame and platform. A friction reducing material such as, for example, Teflon® is applied to the internal surfaces of the tubular frame members 46 and 48, preferably in the form of adhesive strips 76*a* and 76*b*, to reduce friction and minimize lateral movement of the telescoping frame components.

A spring biased pull-pin mechanism 80 is provided on platform 20 for selectively securing the platform in a desired extended or retracted position during utilization. The pull-pin mechanism 80 includes a plunger 82 mounted on frame member 48 and configured to engage a corresponding aperture 84 defined within the wall of platform frame extension 34.

Figure 7:
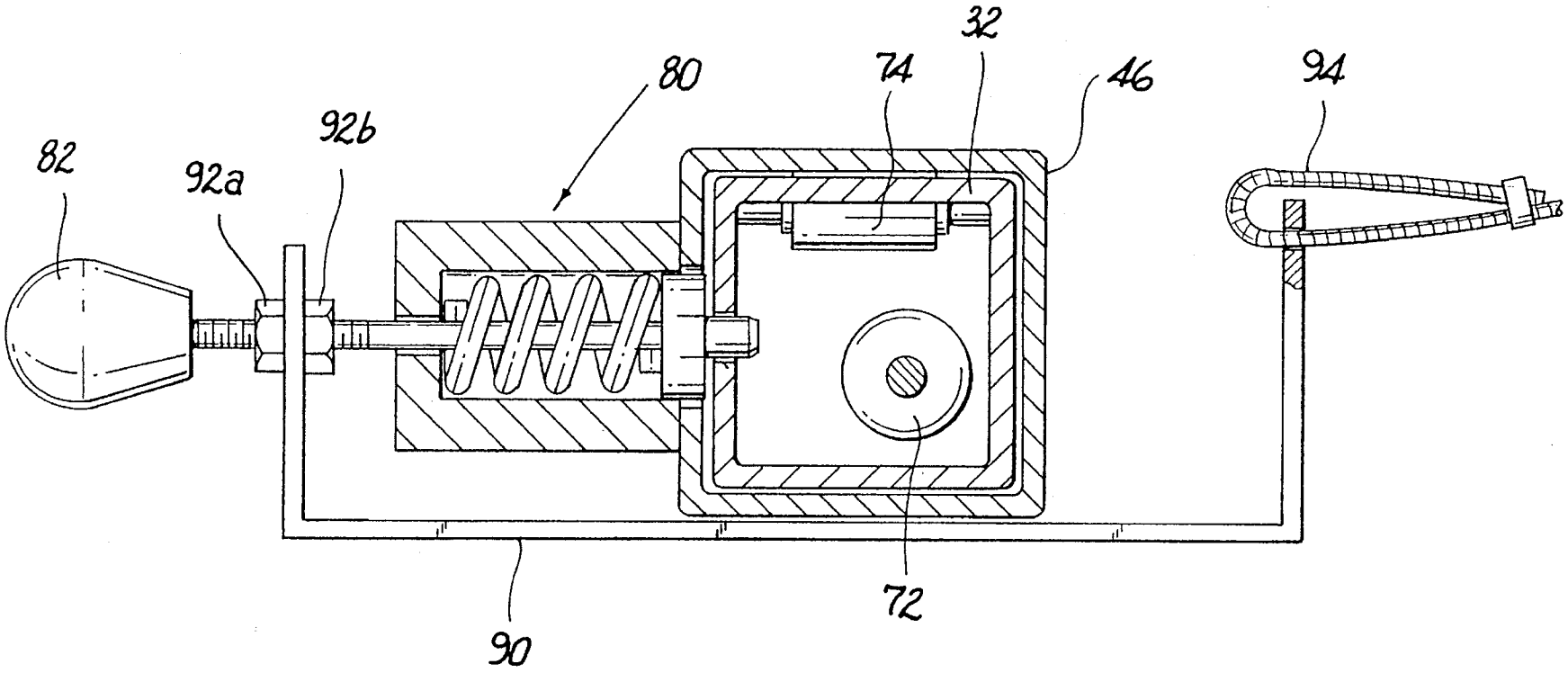
FIG. 7 is a cross-sectional view of the telescoping frame members shown in FIG. 6 illustrating the locking pin ,mechanism and a bracket for facilitating cooperative interaction between two of such mechanisms.

A bracket 90 is illustrated in FIG. 7 for cooperatively interconnecting two adjacent pull-pin mechanisms so that they will operate simultaneously. In this configuration, plunger 82 is fastened to bracket 90 by a pair of locking nuts 92*a* and 92*b* and a connective cable 94 extends from bracket 90 to an adjacent plunger. Thus, when the spring loaded plunger 82 is pulled, so to is the adjacent plunger and both mechanisms will operate simultaneously.

Figure 8:
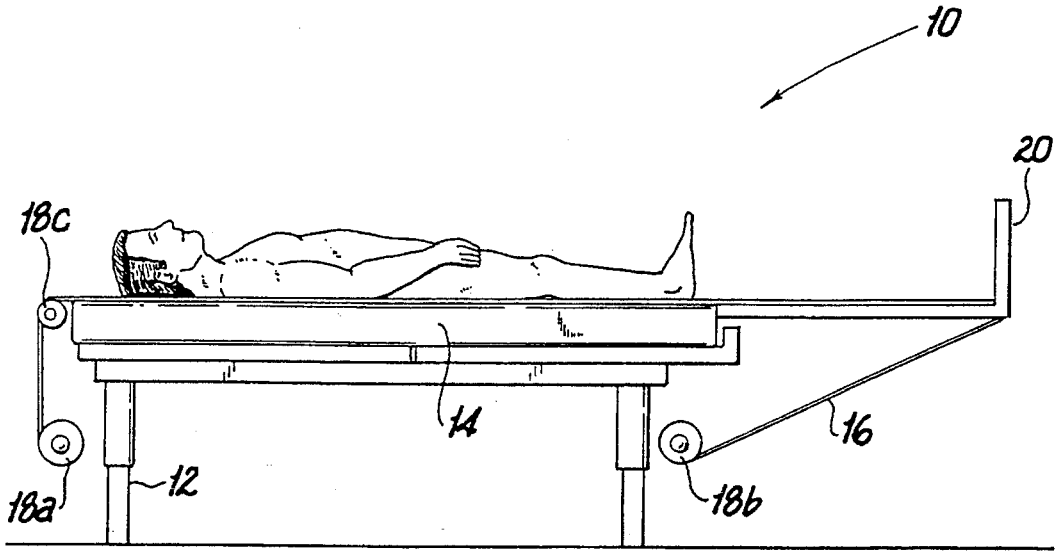
FIG. 8 is a side elevational view of the hospital bed illustrated in FIG. 1 with the platform disposed in an extended position.
Figure 9:
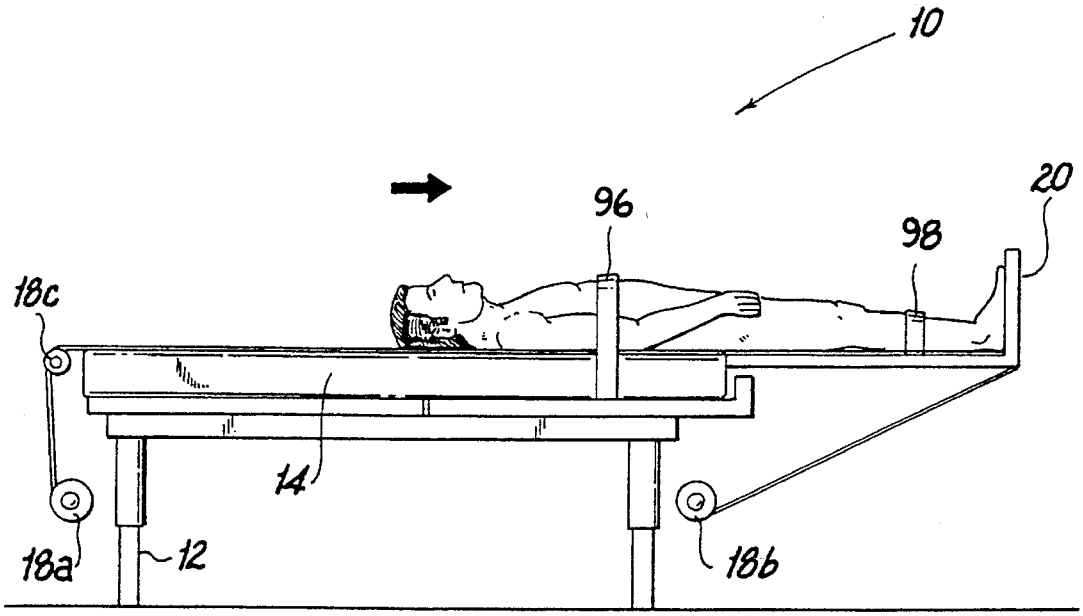
FIG. 9 is a side elevational view of the hospital bed of FIG. 1 with a patient transferred onto the platform and secured with straps.
Figure 10:
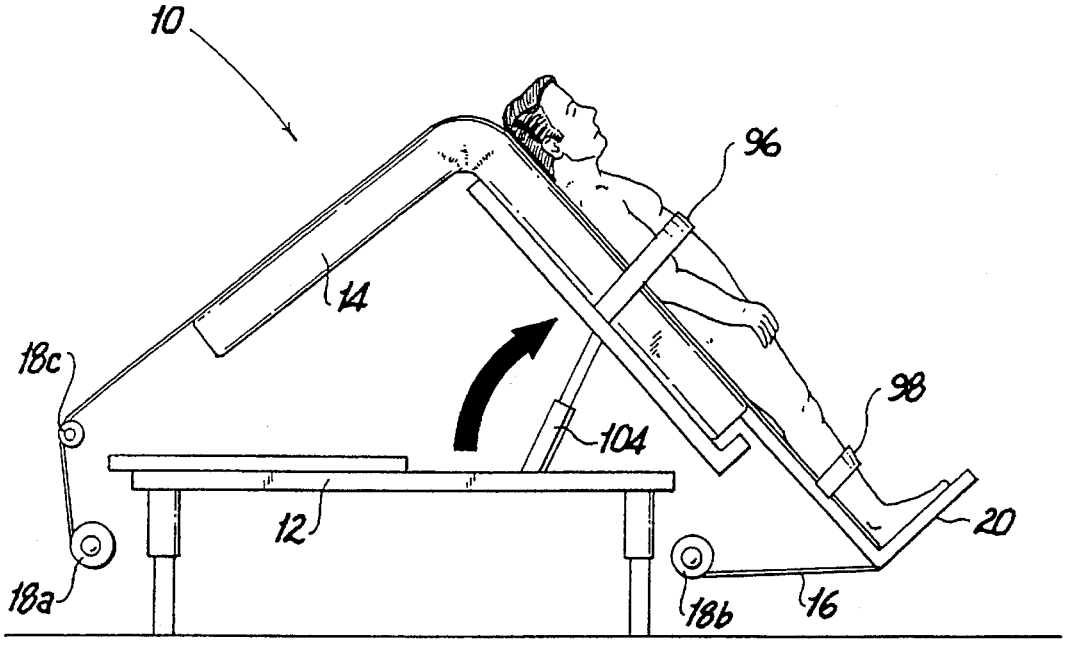
FIG. 10 is a side elevational view of the hospital bed of FIG. 1 disposed in a partially inclined position as the patient is moved toward a standing position.
Figure 11:
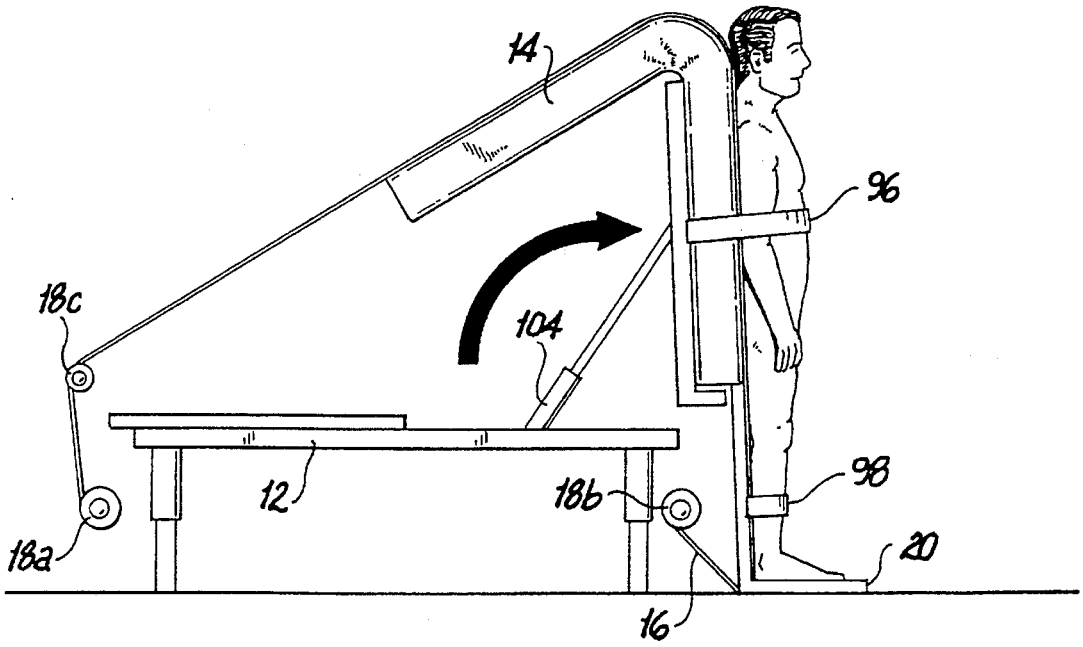
FIG. 11 is a side elevational view of the hospital bed of FIG. 1 disposed in a fully inclined position wherein the patient is in a standing position on the platform.

Turning now to FIGS. 8–11, a patient positioned on hospital bed 10 may be moved from the reclined position illustrated in FIG. 8 to a standing position which is shown in FIG. 11, by initially operating the transport rollers 18*a* and 18*b* to transfer the patient partially onto the extended platform 20, as illustrated in FIG. 9. During this transfer, the patient may be secured to mattress 14 by placing a strap 96 about their torso and a strap 98 about their legs.

Once the patient has been transferred onto platform 20 by transport sheet 16, the user may operate a bed lift system to elevate the patient to a standing position. A hospital bed employing a bed lift system such as that which is utilized in the subject invention, is described, for example, in commonly assigned U.S. Pat. No. 5,103,512, the disclosure of which is herein incorporated by reference. In general, as illustrated in FIGS. 1 and 2, a bed lift system of this type includes opposed mattress lift members 100 and 102 connected to each side of the bed frame 12. Lift members 100 and 102 extend under mattress 14 and are driven by an actuation mechanism (i.e. a linear actuator 104 as shown in FIGS. 10 and 11) to raise a portion of mattress 14 and elevate the patient through a series of inclined positions, shown for example in FIG. 10, to a standing position which is shown in FIG. 11. Once brought to a standing position, the patient may be escorted to a wheel chair, commode, or toilet.

Although the patient transfer system of the subject invention has been described with respect to a preferred embodiment, it will be readily apparent to those having ordinary skill in the art to which the invention appertains that changes and modifications may be made thereto without departing from the spirit or scope of the subject invention as defined by the appended claims.

What is claimed is:

1. A bed comprising:

a) a frame;

b) a mattress positioned on said frame;

c) a transport sheet extending across said mattress;

d) roller means for moving said transport sheet relative to said mattress; and e) means operatively associated with said frame for progressively extending the transport sheet, to provide a patient supporting area beyond said mattress.

2. A bed as recited in claim 1, wherein said means for progressively extending said transport sheet comprises a linearly extendable platform including guide means for accommodating movement of said transport sheet with respect to the platform.

3. A bed according to claim 1 wherein the extending means is retractable to a position where the extending means does not extend beyond said mattress.

4. A bed is recited in claim 2, wherein said guide means comprises a generally cylindrical guide member extending transverse to said transport sheet.

5. A bed as recited in claim 2, further comprising actuation means for moving said platform between a retracted position and an extended position.

6. A bed as recited in claim 5, wherein said platform includes telescoping frame members.

7. A bed as recited in claim 2, wherein said platform includes hinged sections which are foldable into a storage position.

8. A bed as recited in claim 6, wherein said actuation means comprises a rack and pinion assembly.

9. A bed as recited in claim 8, further comprising electrical drive means for operating said rack and pinion assembly.

10. A bed as recited in claim 6, wherein said actuation means comprises a gas spring actuation assembly.

11. A bed as recited in claim 10, wherein said gas spring actuation assembly includes a plurality of gas spring actuators arranged in series within said telescoping frame members.

12. A bed as recited in claim 11, further comprising means for selectively locking and unlocking said telescoping frame members in a desired extended position.

13. A bed as recited in claim 6, further comprising means for reducing friction between said telescoping frame members.

14. A bed as recited in claim 6, further comprising bearing means operatively associated with said telescoping frame members for bearing a load imparted by a patient's legs being supported on said platform.

15. A bed as recited in claim 14, wherein said bearing means comprises radial roller bearings mounted to said telescoping frame members.

16. A bed as recited in claim 1, further comprising lift means for progressively elevating a portion of said mattress to incrementally raise the patient into a selected inclined position.

17. A bed for moving a patient from a reclining position to a standing position comprising:

a) a frame;

b) a mattress positioned on said frame;

c) a conveyor sheet extending across said mattress to define a supporting area for the patient;

d) roller means for moving said conveyor sheet relative to said mattress;

e) means operatively associated with said frame for progressively increasing said patient supporting area of said conveyor sheet; and f) lift means for elevating a portion of said mattress to progressively raise the patient from a reclining position to a standing position.

18. A bed as recited in claim 17, wherein said means for progressively increasing the patient supporting area of said conveyor sheet comprises a linearly extendable platform including a guide member for accommodating movement of said transfer sheet with respect thereto.

19. A hospital bed is recited in claim 18, wherein said guide member comprises a generally cylindrical roller extending traverse to said conveyor sheet.

20. A hospital bed as recited in claim 17, further comprising actuation means for moving said platform between a retracted position and a linearly extended position.

21. A hospital bed as recited in claim 20, wherein said linearly extendable platform includes telescoping frame members.

22. A hospital bed as recited in claim 20, wherein said actuation means comprises a rack and pinion assembly.

23. A hospital bed as recited in claim 22, further comprising electrical drive means for rotating said pinion to cause linear translation of said rack.

24. A hospital bed as recited in claim 20, wherein said actuation means comprises a pneumatic actuation assembly.

25. A hospital bed as recited in claim 24, wherein said pneumatic actuation assembly includes a plurality of pneumatic actuators arranged in series within said telescoping frame members.

26. A hospital bed as recited in claim 25, further comprising means for selectively locking and unlocking said telescoping frame members in a desired extended position.

27. A hospital bed as recited in claim 21, further comprising means for reducing friction between said telescoping frame members.

28. A hospital bed as recited in claim 21, further comprising bearing means operatively associated with said telescoping frame members for bearing a load imparted by a patient's legs being supported on said platform.

29. A hospital bed as recited in claim 28, wherein said bearing means comprises radial roller bearings mounted to said telescoping frame members.

30. A hospital bed for moving a patient from a reclining position on said bed to a standing position at the foot of said bed comprising:

a) a frame;

b) a mattress positioned on said frame;

c) a conveyor sheet extending across said mattress to define a supporting area for the patient;

d) a progressively extendable platform associated with said frame for increasing a longitudinal dimension of said patient supporting area of said conveyor sheet;

e) roller means for moving said conveyor sheet relative to said bed to transport a reclining patient across said mattress and partly onto said platform; and f) lift means for elevating a portion of said mattress to progressively raise the patient from said reclining position to said standing position.

31. A hospital bed as recited in claim 30, wherein said platform includes guide means for accommodating :movement of said conveyor sheet with respect thereto.

32. A method for transferring a patient from a reclining position on a bed to an inclined position at the foot of said bed, said bed including a mattress, and a transport sheet extending across said mattress and moveable with respect thereto, said transport sheet defining a patient supporting area, said method comprising the steps of:

a) extending a platform from an end of said bed to increase said patient supporting area defined by said transport sheet;

b) moving said transport sheet relative to said mattress to transport a reclining patient across said mattress and partly onto said platform; and c) lifting a portion of said mattress to elevate the patient from said reclining position to said inclined position.

33. A method for transferring a patient as described in claim 32 wherein said inclined position may be a standing position.

* * * * *